United States Patent [19]

Freakes et al.

[11] 4,022,332

[45] May 10, 1977

[54] APPARATUS FOR ORIENTING CASE BLANKS

[75] Inventors: Anthony Freakes, Leonia; George A. Ventz, Clifton, both of N.J.; Arthur I. Dove, Flushing, N.Y.

[73] Assignee: General Corrugated Machinery Co., Inc., Palisades Park, N.J.

[22] Filed: July 16, 1975

[21] Appl. No.: 596,225

[52] U.S. Cl. ..... 214/6 C; 198/413; 214/1 QA; 271/3.1; 271/150; 271/258; 271/265

[51] Int. Cl.[2] ..... B65G 57/14

[58] Field of Search ..... 214/6 C, 6 D, 1 Q, 1 QA; 198/21, 35, 37, 283, 284, 285, 413; 271/3.1, 258, 259, 265, 150

[56] References Cited

UNITED STATES PATENTS

| | | | |
|---|---|---|---|
| 2,527,024 | 10/1950 | Mitchell | 214/1 QA |
| 2,805,757 | 9/1957 | Rapley | 198/35 |
| 2,847,110 | 8/1958 | Rysti | 198/35 |
| 2,973,202 | 2/1961 | Schmeck et al. | 271/259 |
| 3,422,969 | 1/1969 | Miller et al. | 271/3.1 |
| 3,727,744 | 4/1973 | Willard | 214/1 QA |

*Primary Examiner*—Robert J. Spar
*Assistant Examiner*—Ross Weaver
*Attorney, Agent, or Firm*—Samuelson & Jacob

[57] ABSTRACT

An apparatus receives case blanks in a given faced orientation within an upright stack and delivers the blanks in shingled arrangement in reverse faced orientation. Two forks are pivoted about a common pivotal axis and move independent of one another, in response to a control system, to upset the upright stack and establish the shingled arrangement and reverse faced orientation.

16 Claims, 12 Drawing Figures

APPARATUS FOR ORIENTING CASE BLANKS

The present invention relates generally to apparatus for handling case blanks and pertains, more specifically, to apparatus in which case blanks received in an upright stack, usually from one machine, such as a corrugator, are appropriately oriented and readied for delivery to additional machinery for further processing.

In the manufacture of corrugated paper cases or boxes, case blanks are first fabricated in a machine known as a corrugator, and are then delivered to further machinery which, among other operations, will place printed matter on a face of each blank. As production rates are increased, it becomes advantageous to employ apparatus for automatically delivering the case blanks from one machine to another as the cases or boxes are manufactured.

Because the rate at which the corrugator can manufacture case blanks is greater than the rate at which the printer can print the blanks, and since the output of the corrugator is in the form of blanks of different widths, the output of the corrugator is accumulated in upright stacks of blanks and the blanks are then delivered from such stacks to the hopper of the printer. In addition, since each blank has an outside face and an inside face, the blanks must be oriented properly when delivered to the printer so that the appropriate face of each blank is presented for printing. Printers have been developed for printing case blanks where the face to be printed is oriented upwardly and are known as top printers. Likewise, bottom printers have been evolved for printing case blanks where the face to be printed is oriented downwardly. Since corrugators generally deliver case blanks with the appropriate face oriented downwardly and since many manufacturers prefer to employ top printers, there is a need for apparatus which will deliver the case blanks in a faced orientation which is the reverse of the faced orientation of the blanks in the upright stacks received from the corrugator.

In addition, as pointed out in U.S. Pat. No. 3,422,969, it may be necessary to re-orient case blanks as the blanks proceed from the printer to further machinery employed in the manufacture of the cases. The patent describes apparatus intended to deliver case blanks whose faced orientation at the output of the machine is the reverse of that in the vertical stack delivered to the input of the machine.

It is therefore an important object of the present invention to provide an improved apparatus for receiving an upright stack of case blanks and delivering the case blanks in a faced orientation which is the reverse of the faced orientation of the case blanks in the upright stack.

Another object of the invention is to provide apparatus of the type described above in which first and second forks are mounted for pivotal movement about a common pivotal axis, but independent of one another, to manipulate the upright stack into a shingled arrangement of case blanks whose faced orientation is the reverse of their original faced orientation in the upright stack.

Still another object of the invention is to provide apparatus of the type described above and in which the first and second forks each have a plurality of tines and the tines of one fork are aligned longitudinally with corresponding tines of the other fork for increased effectiveness and added flexibility of operation.

A further object of the invention is to provide apparatus in which individual discrete upright stacks of case blanks having a given faced orientation are received and then delivered in a continuous stream of case blanks in shingled arrangement in reverse faced orientation, thereby facilitating unattended operation.

A still further object of the invention is to provide apparatus of the type described above which is rugged and durable, yet simple in design and construction, which is capable of relatively economical manufacture and enables ease of use.

The above objects, as well as still further objects and advantages, are attained by the invention which may be described briefly as apparatus for receiving blanks in given faced orientation within an upright stack having a longitudinal length and an altitudinal height, and delivering the blanks in shingled arrangement in reverse faced orientation, the apparatus comprising a frame, a plurality of laterally spaced, longitudinally extending movable means mounted on the frame to establish a longitudinal conveyor having an input end and an output end, and providing a longitudinal path of travel for the blanks between the input end and the output end, drive means for moving the plurality of laterally spaced, longitudinally extending movable means to convey the blanks along the longitudinal path of travel in a donwstream direction between the input end and the output end, a first fork mounted upon the frame for pivotal movement about a laterally extending pivotal axis, the first fork including a plurality of longitudinally extending, laterally spaced first tines, the lengths of at least some of the first tines being greater than the height of the stack, a second fork mounted upon the frame for pivotal movement independent of the first fork about the same laterally extending pivotal axis, the second fork including a plurality of longitudinally extending, laterally spaced second tines, the lengths of at least some of the second tines being great enough to support the length of the stack, first actuating means for pivotally moving the first fork independent of the second fork between a first position wherein the first tines extend in an altitudinal direction normal to and intercepting the longitudinal path of travel of the blanks, and a second position wherein the first tines extend in a first longitudinal direction parallel to and juxtaposed with the path of travel, second actuating means for pivotally moving the second fork independent of the first fork between a first position wherein the second tines extend in a second longitudinal direction parallel to and juxtaposed with the path of travel and opposite to the first longitudinal direction, and a second position wherein the second tines extend in an altitudinal direction at an obtuse angle to the second longitudinal direction and intercept the path of travel, and a control system including control means located along the path of travel of the blanks for activating the first and second actuating means in response to the location of the blanks such that upon disposition of the stack at a predetermined upsetting location wherein the stack is juxtaposed with the first and second forks, with each fork positioned at the first position thereof, the first and second actuating means will effect synchronized rotational movement of the forks in the same direction of rotation to the second positions thereof, for upsetting the stack and placing the blanks in shingled arrangement upon the conveyor for delivery to the output end thereof, with the faced orientation of the delivered blanks being the reverse of the faced orientation of the blanks when in the stack.

The invention will be more fully understood, while still further objects and advantages thereof will become apparent, by reference to the following detailed description of an embodiment thereof illustrated in the accompanying drawing, in which:

FIGS. 1 through 4 are diagrammatic, elevational views showing the progression of case blanks through apparatus constructed in accordance with the invention;

FIGS. 5 and 6, joined along the line X—X, together constitute a side elevational view of the apparatus;

Figure 1:
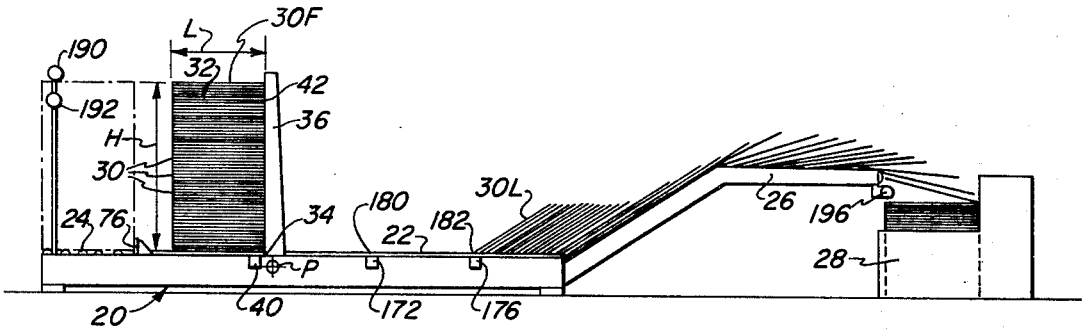
Figure 2:
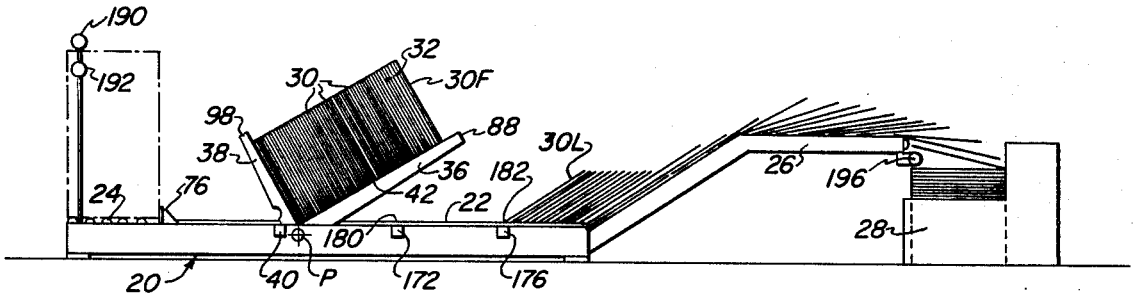
Figure 3:
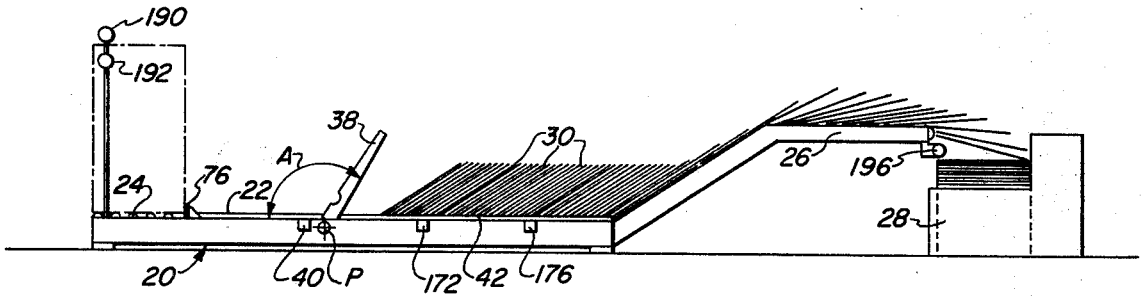
Figure 4:
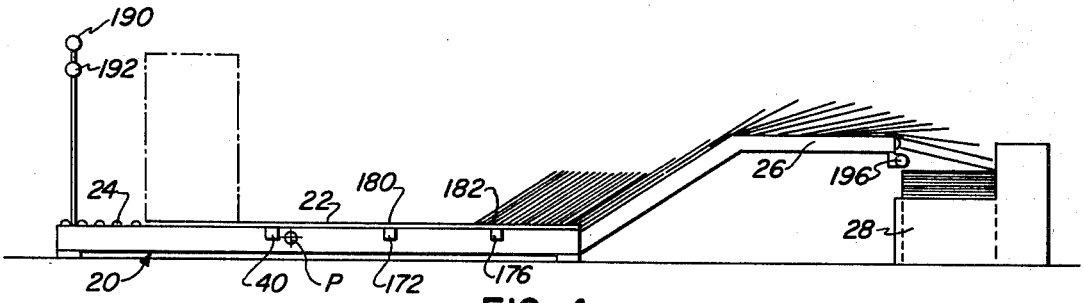

Referring now to the drawing, and especially to FIGS. 1 through 4 thereof, the operation of an apparatus constructed in accordance with the invention is illustrated in diagrammatic fashion in connection with machine 20. Machine 20 is intended to deliver case blanks whose faced orientation at the output of the machine is the reverse of that in the upright stack presented to the input of the machine. Machine 20 includes a conveyor 22 which carries case blanks in a downstream direction from an infeed conveyor section 24 to an output conveyor section 26, which delivers the case blanks to a hopper 28, usually associated with another machine which will utilize the case blanks.

Case blanks 30 are presented to machine 20 in an upright stack 32 having a longitudinal length L and an altitudinal height H. The infeed conveyor section 24 brings the stack 32 to the central section of conveyor 22 which then carries the stack 32 to an upsetting location 34 where the stack is juxtaposed with a long fork 36 and a short fork 38. The presence of the stack 32 at upsetting location 34 is detected by a sensing means 40. The conveyor 22 is then stopped and the forks 36 and 38 are pivoted, or rotated, about pivotal axis P in a forward, or downstream direction, toward the output end of the conveyor until the leading edges 42 of the case blanks 30 come to rest upon conveyor 22. The leading edges 42 rest upon conveyor 22 in a relatively unstable position; however, as short fork 38 continues its forward rotation, the unstable condition does not persist for long and the case blanks 30 are pushed onto conveyor 22 in a faced orientation reversed from that which they had in the original upright stack. Short fork 38 is then retracted to prepare for the upsetting of the next subsequent upright stack. The conveyor 22 is started and case blanks 30 proceed along conveyor 22 and through output conveyor section 26 in a feathered or shingled arrangement to be delivered to hopper 28 from which the case blanks will be fed automatically through another machine, such as a printer, for further processing.

Turning now to FIGS. 5 through 11, the apparatus whose general operation has just been described in connection with FIGS. 1 through 4 will now be described in greater detail. Machine 20 has a frame 50 which extends longitudinally between an input end 52 and an output end 54 of the machine. The output end 54 is raised relative to the input end 52 to enable the output of machine 20 to be delivered directly to the hopper 28 (as in FIGS. 1–4) of another machine. The frame 50 includes laterally spaced apart side rails 56 and 58.

Conveyor 22 is located between the side rails 56 and 58 of the frame 50 and includes a plurality of laterally spaced, longitudinally extending moving means in the form of endless belts 60, 62 and 64 mounted on appropriate lateral shafts which are journaled for rotation in the frame in a now-conventional manner. Belts 60 extend into the infeed conveyor section 24 which also includes a plurality of idler rollers 66 for handling the incoming stack 32 of case blanks 30 at the input end of the conveyor. Belts 60 and 62 deliver the case blanks to belts 64 which make up the output conveyor section 26. A first drive motor unit 67 is coupled to shaft 68 and drives belts 60 and 62, while a second drive motor unit 70 is coupled to shaft 72 and drives belts 64. All of the belts are thus driven by drive means in a direction which will convey the case blanks along a longitudinal path of travel, in a downstream direction as indicated by arrow 74, from the input end of the conveyor to the output end of the conveyor.

Figure 7:
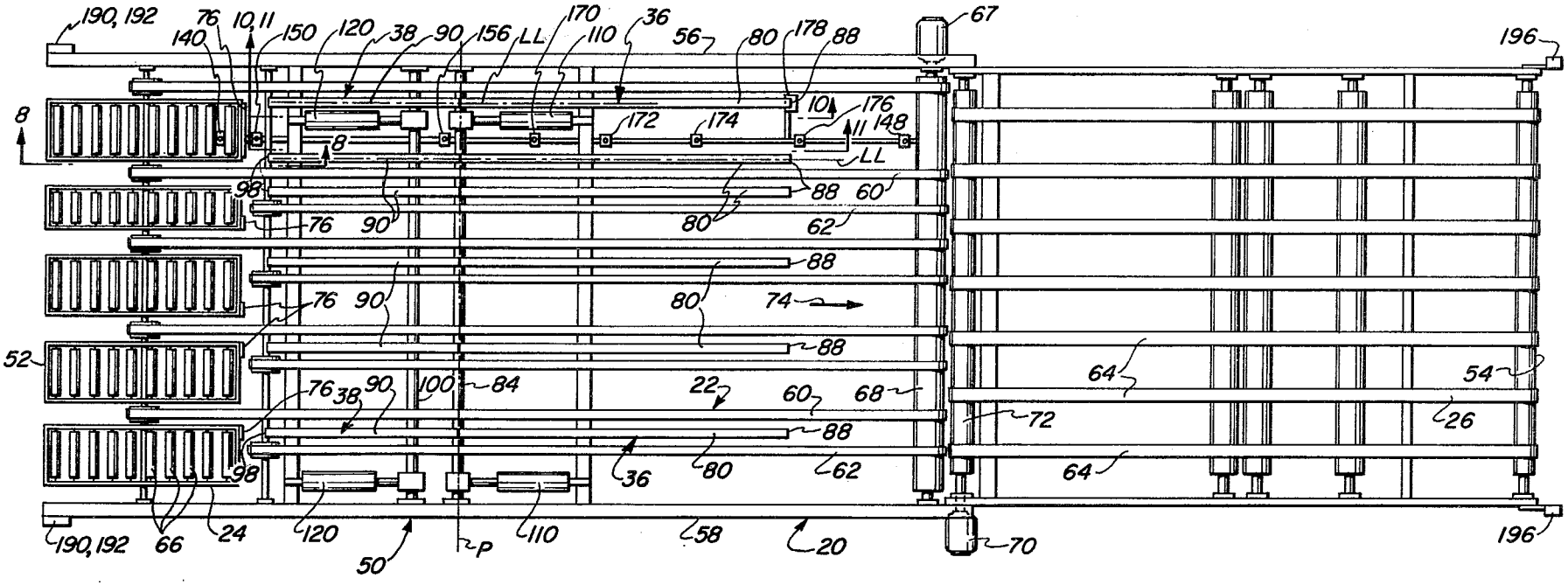
FIG. 7 is a top plan view of the apparatus.
Figure 8:
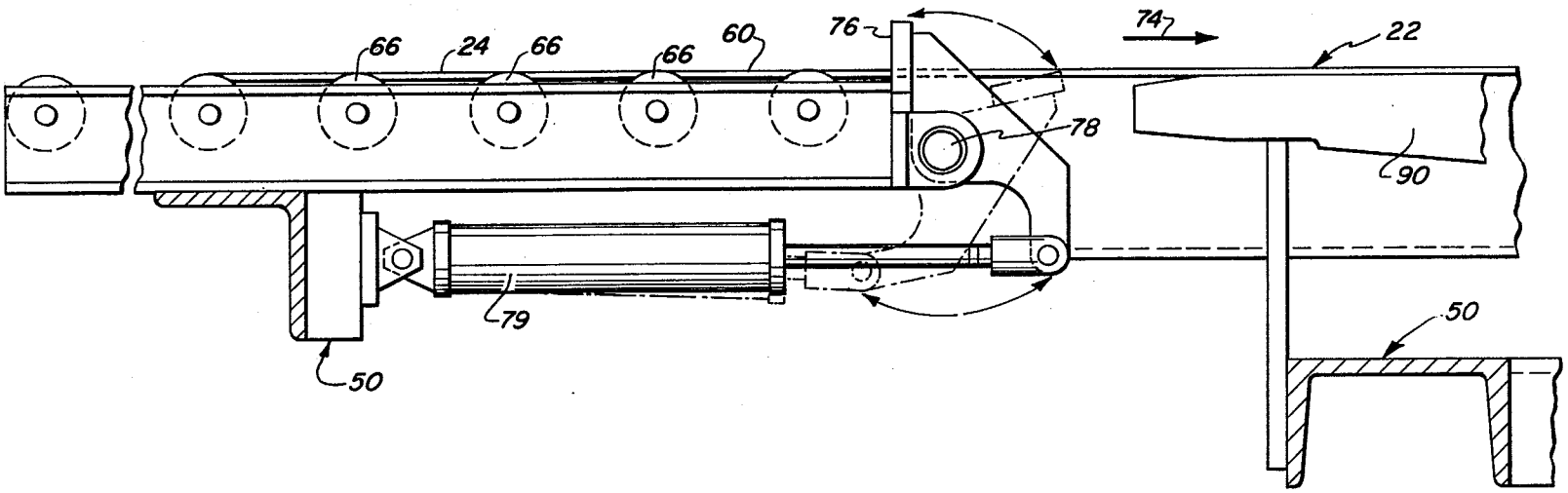
FIG. 8 is an enlarge cross-sectional view taken along line 8—8 of FIG. 7.

As best seen in FIGS. 7 and 8, a plurality of gates 76 are mounted upon frame 50 and intercept the path of travel of the stack 32, when the gates are in the position illustrated in full lines in FIG. 8, to retain the stack at the infeed conveyor section 24 until the stack is to travel further downstream. Gates 76 are mounted on frame 50 for pivotal movement at 78. An actuator in the form of air cylinder 79 is coupled to each gate 76 for movement of the gates between a first positioned, illustrated in full lines in FIG. 8, and a second position, seen in phantom in FIG. 8. When the gates are in the second position, the stack is free to proceed downstream on the conveyor 22.

Referring now to FIGS. 7 and 9–11, the long fork 36 includes a plurality of longitudinally extending, laterally spaced long tines 80 which are affixed at their upsteam ends 82 to a first drive shaft 84, for rotation therewith, by means of drive pins 86. Long tines 80 extend in a downstream direction from ends 82 to their tip ends 88 and have a length which is somewhat greater than the height H of the stack 32 of case blanks 30 (see FIGS. 1–4). Drive shaft 84 extends laterally across the frame 50 beneath the path of travel of the case blanks and is journaled for rotation in the frame so that long fork 36 is mounted on the frame for pivotal movement about the central axis of drive shaft 84, which coincides with pivotal axis P.

Figure 9:
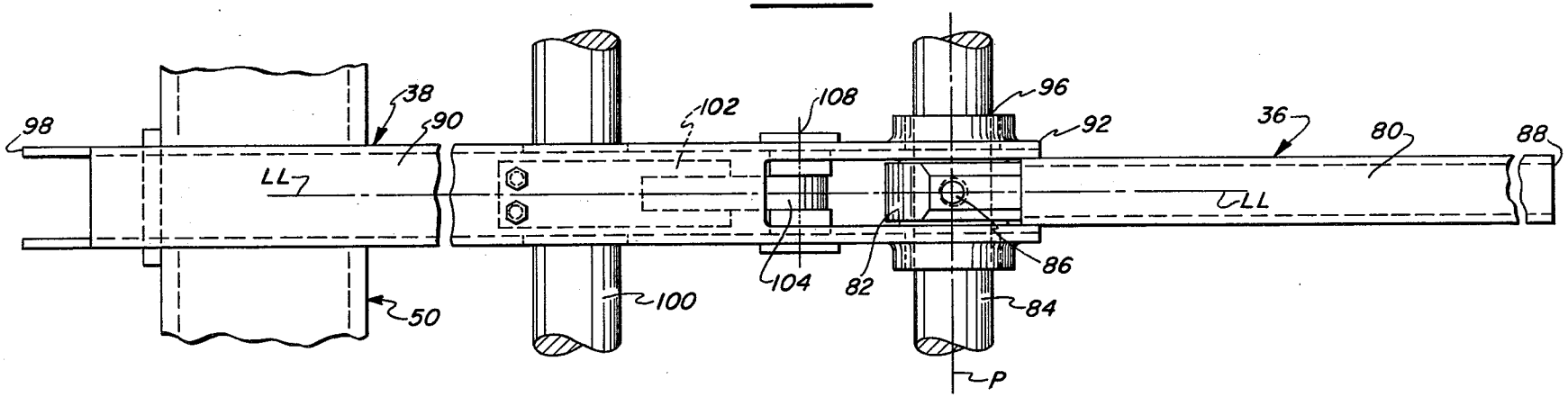
FIG. 9 is an enlarged fragmentary plan view of a portion of FIG. 7.
Figure 10:
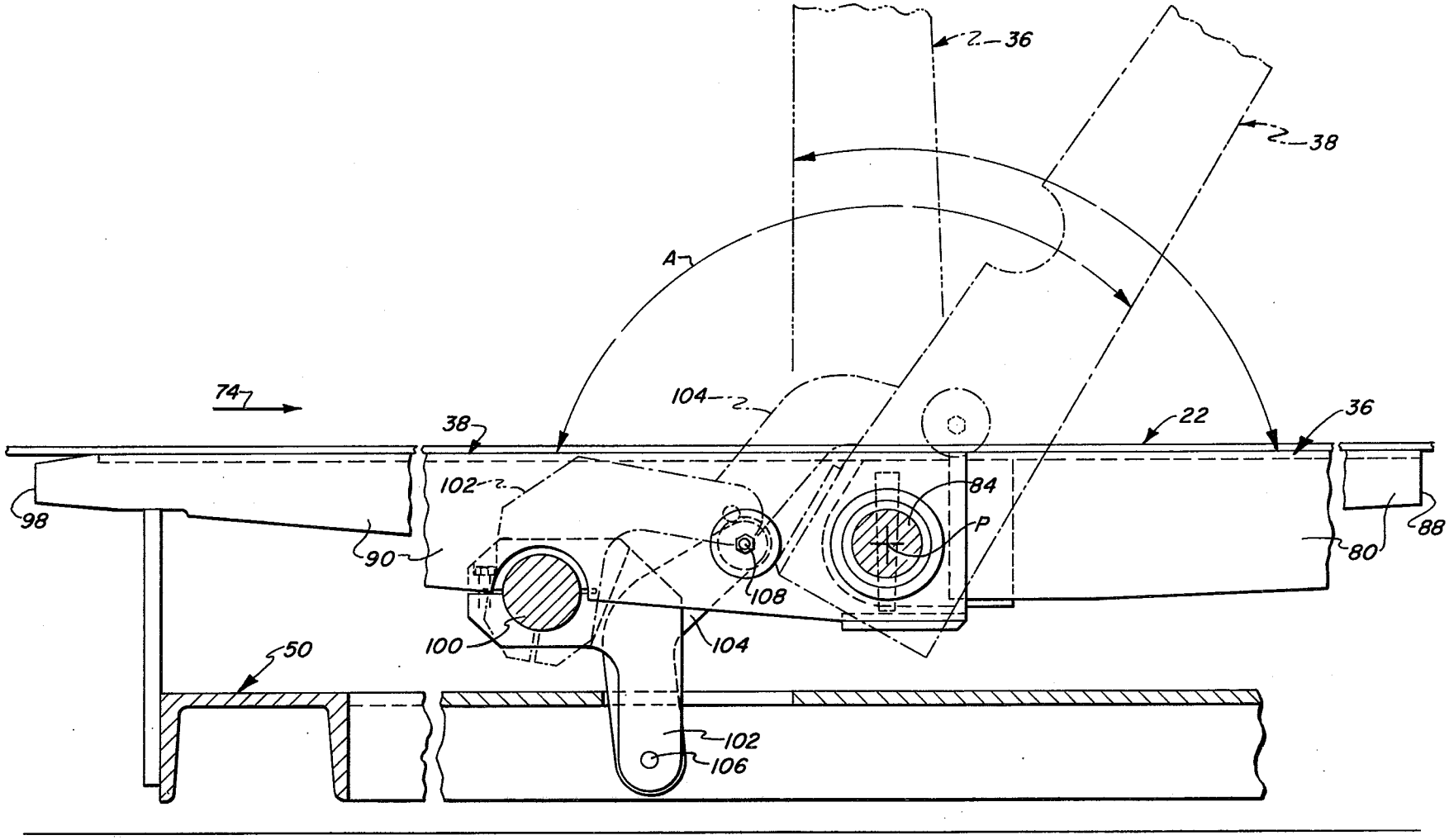
FIG. 10 is an enlarged cross-sectional view taken along line 10—10 of FIG. 7.
Figure 11:
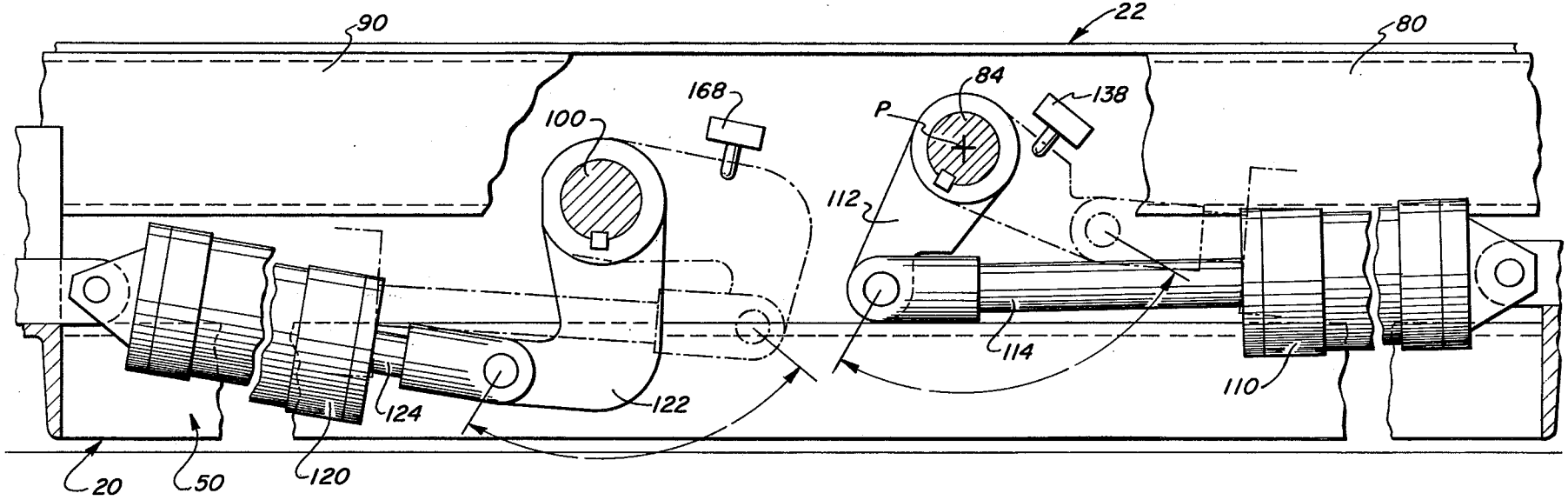
FIG. 11 is an enlarged cross-sectional view taken along line 11—11 of FIG. 7.

The short fork 38 includes a plurality of longitudinally extending, laterally spaced short tines 90 which are journaled at their downstream ends 92 upon first drive shaft 84 at 96 for rotation relative to the first drive shaft. Short tines 90 extend in an upstream direction from ends 92 to their tip ends 98 and have a length sufficient to support the stack 32 along its length L (see FIGS. 1–4). A second drive shaft 100 extends laterally across frame 50, parallel to first drive shaft 84 and spaced longitudinally upstream therefrom, and is journaled for rotation in the frame. As best seen in FIGS. 9 and 10, drive shaft 100 passes beneath the path of travel of the case blanks and beneath each short tine 90 and carries a plurality of cranks 102, each crank 102 being associated with and adjacent to a corresponding tine 90 being affixed to drive shaft 100 for rotation therewith. Each crank 102 is coupled to its corresponding tine 90 by means of a drive link 104 pinned to the crank 102 at 106 and to the tine 90 at 108. Thus, the short fork 38 is mounted on frame 50 for pivotal movement about the same pivotal axis P and the pivotal movement of short fork 38 is independent of the pivotal movement of long fork 36.

It is noted that the above-described arrangement enables corresponding tines 80 and 90 of long fork 36 and short fork 38 to be aligned longitudinally along common longitudinal lines LL, thereby enabling more effective handling of the case blanks 30 and enabling greater flexibility in handling a variety of case blanks widths. Thus, since each tine 90 lies along the same line LL of a tine 80 there is no tendency for the case blanks to be tilted or skewed as the load is shifted from one fork to the other. Since tines 80 and 90 lie along common lines LL, the lateral spacing between adjacent lines LL of tines is readily chosen to accommodate case blanks of various widths (the dimension in the lateral direction). Thus, as seen in FIG. 7, lines LL of tines 80 and 90 may be located closer together at the side of the machine adjacent side rail 56 of frame 50 to accommodate narrower case blanks along that side of the machine, without disturbing the even lateral spacing between the conveyor belts 60 and 62. Tines 80 and 90 are placed laterally between the conveyor belts 60 and 62 and can be located anywhere, in almost any desired number, between the belts, and the spacing between adjacent belts can be held to a minimum.

Turning now to FIGS. 5, 7, 10 and 11, the means for actuating the long fork 36 includes first actuators in the form of hydraulic cylinders 110, each coupled to drive shaft 84 by means of a crank arm 112 and a drive rod 114. By movement of each rod 114 and arm 112 between the position shown in phantom in FIG. 11 and the position shown in full lines, drive shaft 84 will be rotated clockwise to move the long fork 36 between a first position, wherein tines 80 extend in an altitudinal direction normal to and intercepting the path of travel of the case blanks, as seen in phantom in FIGS. 5 and 10 (and in full lines in FIG. 1), and a second position wherein the tines 80 extend in the downstream direction, parallel to and juxtaposed with the path of travel of the case blanks, as seen in full lines in FIG. 10.

The means for actuating the short fork 38 includes second actuators in the form of hydraulic cylinders 120, each coupled to drive shaft 100 by means of a crank arm 122 and a drive rod 124. By movement of each rod 124 and arm 122 between the position shown in full lines in FIG. 11 and the position shown in phantom, drive shaft 100 will be rotated counterclockwise, thereby moving each crank 102 between the position shown in full lines in FIG. 10 and the position shown in phantom and thus moving the short fork 38 between a first position wherein tines 90 extend in the upstream direction, as seen in full lines in FIG. 10, and a second position wherein tines 90 extend in an altitudinal direction at an obtuse angle A to the upstream direction and intercept the path of travel of the case blanks, as shown in phantom in FIGS. 5 and 10 (and in full lines in FIG. 3). Angle A is about 120°.

It is noted that the forks 36 and 38 are each ordinarily moved from their respective first positions to their respective second positions at the same rate of movement so that the stack 32 carried within the fork is maintained in an orderly, stable arrangement. However, under certain circumstances, such as with blanks having larger lengths (the L dimension), it is desirable to have the short fork 38 move at a slightly slower rate than the long fork 36 so that the blanks 30 in the stack 32 will lean backwards slightly as the stack is upset until the leading edges 42 of blanks 30 come to rest upon the conveyor 22. Then, the short fork will continue to move to its second position to push the blanks onto the conveyor in reverse faced orientation. Thus, any tendency for the longer blanks to fall forward in a random manner prior to being pushed uniformly by the short fork as the upset stack reaches the conveyor is defeated. Since the forks 36 and 38 are actuated by independent actuators, the rate of movement of one fork can be selected independent of the rate of movement of the other fork. Movement of both forks from their respective first positions to their respective second positions is in the same direction of rotation and effects movement of the tines, and the stack of case blanks carried by the tines, in a downstream direction. Since power is transmitted to the forks through two separate, independent drive shafts 84 and 100, both of which extend laterally entirely across the frame between side rails 56 and 58, even though both forks are pivoted about the same pivotal axis P, the machine 20 is made more rugged and durable while maintaining an effective, flexible arrangement of the tines of the forks.

Figure 12:
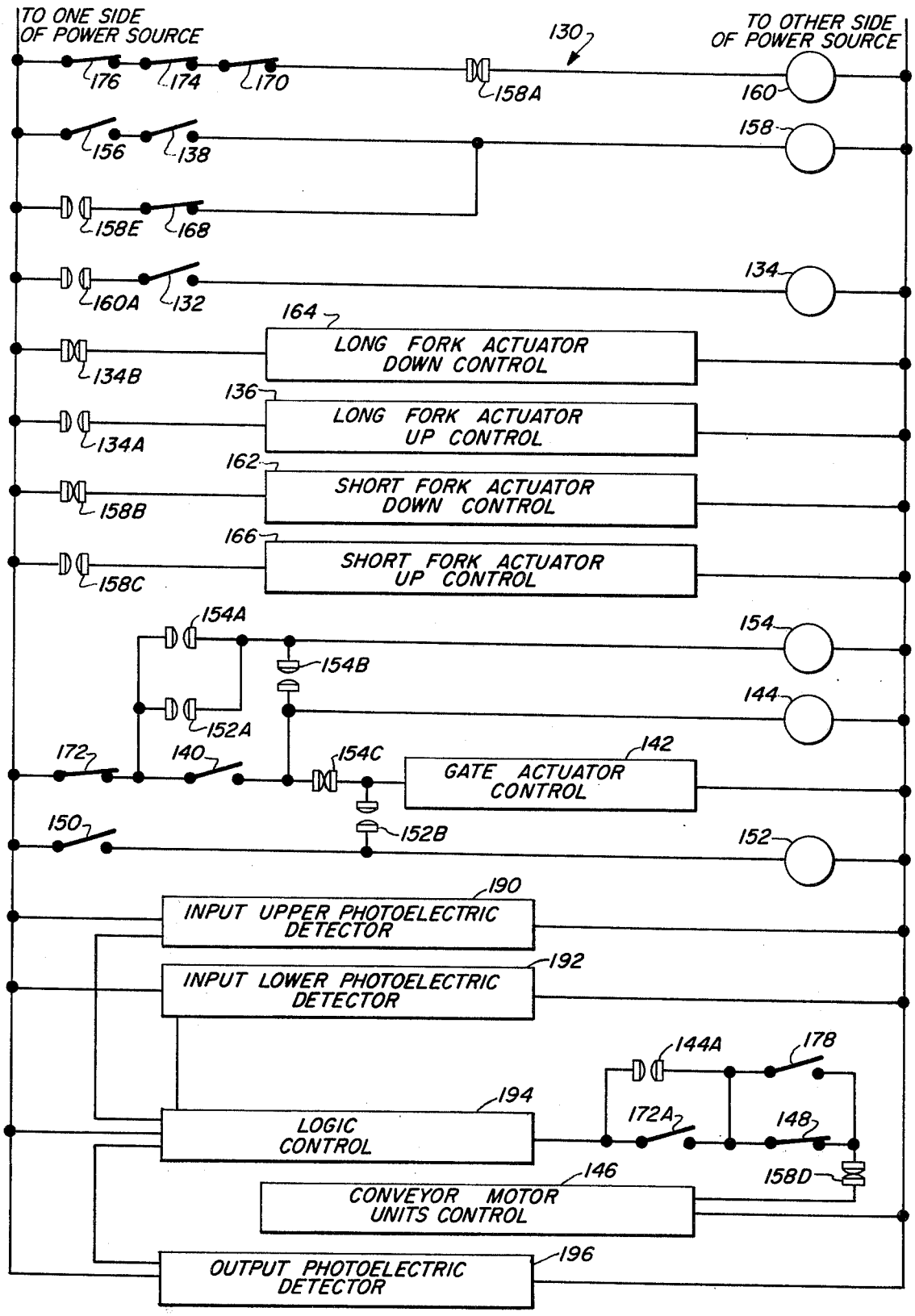
FIG. 12 is a partially schematic circuit diagram of the control system of the apparatus.

In order to effect the operation of machine 20 in the manner described above in connection with FIGS. 1 through 4, machine 20 is provided with an electrical control system 130 illustrated, essentially schemmatically, in FIG. 12. The physical location of the various switches and photoelectric detectors will be found in FIGS. 1–4, 6, 7 and 11. In the circuit diagram of FIG. 12, those switches and relays which have more than one section or more than one set of contacts will be referred to with a primary reference character, while the different sections and contacts will carry different letter designations.

Referring now to the circuit diagram of FIG. 12, machine 20 is started by closing main operator switch 132, thereby actuating relay 134 to close contacts 134A which, in turn, energize the long fork actuator up control 136 to move the long fork 36 into its first position (as seen in FIG. 1). When the long fork 36 reaches its first position, switch 138 (see FIG. 11) is closed by crank arm 112. A stack 32 of case blanks 30 is positioned against gates 76, closing a limit switch 140 which, in turn, energizes the gate actuator control 142 to lower the gates 76 and energizes conveyor control relay 144. Conveyor control relay 144 closes contacts 144A to energize conveyor motor units 146, through limit switch 148, to operate the conveyor belts 60, 62 and 64. With the gates 76 down and the conveyor operating, the stack proceeds downstream, closing limit switch 150 which energizes interlock relay 152 to close contacts 152A and 152B and keep the gate actuator control 142 energized. Interlock relay 152 also energizes relay 154 to close contacts 154A and 154B and open contacts 154C, thereby isolating switch 140 so that the next subsequent stack at the gate will not energize the gate actuator control 142 until the system is reset.

After stack 32 passes limit switch 150, allowing switch 150 to open, gate actuator control 142 is de-energized, raising the gate. At the same time, interlock relay 152 is de-energized, opening contacts 152A and 152B; however, switch 140 is still isolated by contacts 154A and 154B of relay 154. When the stack 32 arrives at the upsetting location 34, sensing means 40 actuates a limit switch 156 which, in turn, energizes relay 158 (switch 138 having previously been closed) to open contacts 158A, thereby de-energizing relay 160 to open contacts 160A and thus to de-energize relay 134 to open contacts 134A and close contacts 134B. At the same time, contacts 158B open and contacts 158C close. In this manner the long fork actuator up control 136 is de-energized, the short fork actuator down control 162 is de-energized and the long fork actuator down control 164 and the short fork actuator up control 166 are both energized to move both forks, in synchronism, from their respective first positions toward their respective second positions. Further, at the same time, contacts 158D are opened to de-energize the conveyor motor units control 146 and stop the conveyor. Relay 158 is self-maintained through contacts 158E and switch 168 (see FIG. 11), which remains closed. Should it be desired to start the short fork movement slightly after the long fork commences its movement, a time delay may be placed in the short fork actuator up control.

When the long fork reaches its second position (down), limit switches 170, 172, 174 and 176 open while limit switch 178 closes in response to the position of the tines of the long fork, and a second section 172A of switch 172 closes. Limit switches 176, 174 and 170 will remain open until the blanks 30 clear the long fork 36 as they travel in the downstream direction. Short fork 38 continues toward its second position (up — at obtuse angle A) and when it arrives at the second position, switch 168 is opened by crank arm 122 to de-energize relay 158, thereby opening contacts 158C to de-energize the short fork actuator up control 166 and to energize the short fork actuator down control 162 through contacts 158B, causing the short fork to retract to its first position. At the same time, contacts 158D close to energize conveyor motor units control 146 to once again operate the conveyor belts 60, 62 and 64.

The case blanks 30, now in shingled arrangement, proceed in the downstream direction until the last blank 30L passes switch 172 allowing switch 172 to close, while section 172A of switch 172 opens to stop the conveyor belts. If no subsequent stack is at the gates 76, the conveyor remains stopped until a stack is placed at the gates and closes limit switch 140. If a stack is at the gates 76, limit switch 140 is closed, the gate lowers, and the stack proceeds to the upsetting location 34, closing limit switch 156. When the subsequent stack reaches the upsetting location 34, the last blank 30L of the previous stack clears the downstream end of the long fork and limit switch 176. Limit switches 170, 174 and 176 all have become closed enabling energization of relay 160 which, in turn, energizes relay 134. Relay 134 closes contacts 134A and opens contacts 134B, which causes the long fork 36 to rise from the second position toward the first position thereof. As the long fork leaves its second position, limit switch 178 is opened, stopping the conveyor. When the long fork reaches its first position (up), switch 138 is closed and the operating cycle can continue as described above. Limit switches 170 and 174 assure that no gaps appear in the stream of blanks which could interrupt the prescribed sequence of operation.

One of the objectives of machine 20 is to deliver blanks 30 in a continuous stream of blanks in shingled arrangement at the output end of the machine, while the input is in the form of the discrete stacks 32 of case blanks 30. A continuous stream, having no gaps, facilitates unattended operation in that deleterious interruptions in blank feed are precluded. In order to assure that the stream is continuous and that there is no gap in the stream between the last blank 30L of a previous stack and the initial blank 30F of a subsequent stack (see FIGS. 1–3), limit switch 172 serves as a first blank-detecting means to determine when the last blank 30L of an upset stack 32 is positioned at a first point 180 located between the input end of the conveyor 22 and the terminal end of the long fork 36 at tine tip ends 88. Limit switch 176 serves as a second blank-detecting means to determine when the last blank 30L is positioned at a second point 182 located downstream beyond the terminal end of the long fork. The longitudinal distance between the first and second points 180 and 182 is chosen so that the initial blank 30F of a subsequent upright stack of given height H and length L must overlap with the first blank 30L of a previous upset stack when the subsequent stack is itself upset. Since the subsequent stack 32 must travel from the gates 76 to the upsetting location 34 while the last blank 30L travels from the first point 180 to the second point 182, the distance between first and second points 180 and 182 is a function of the distance between the gates 76 and the upsetting location 34 and the given height and length of the subsequent stack. By placing the limit switch 172 a proper distance upstream from limit switch 176, the conveyor 22 is stopped when the last blank is located at the first point, and continued operation is dependent upon placing the next subsequent stack at the gate so that the last blank of the previous stack cannot travel downstream beyond the point where it will be overlapped by the initial blank of the next subsequent stack.

Figure 5:
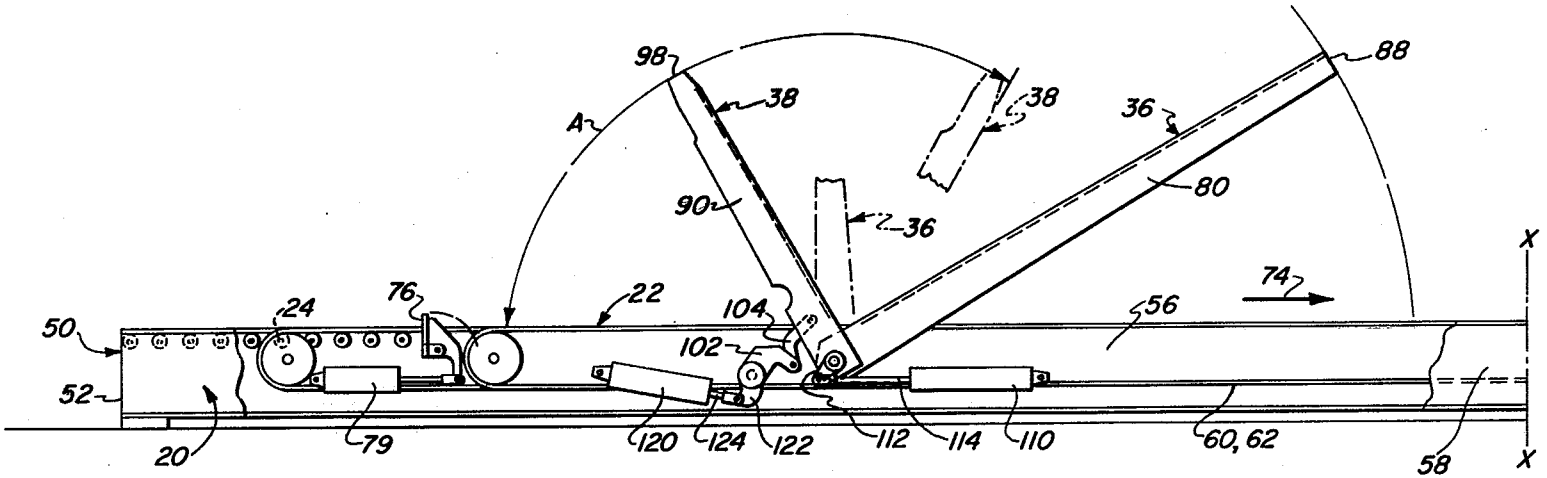
Figure 6:
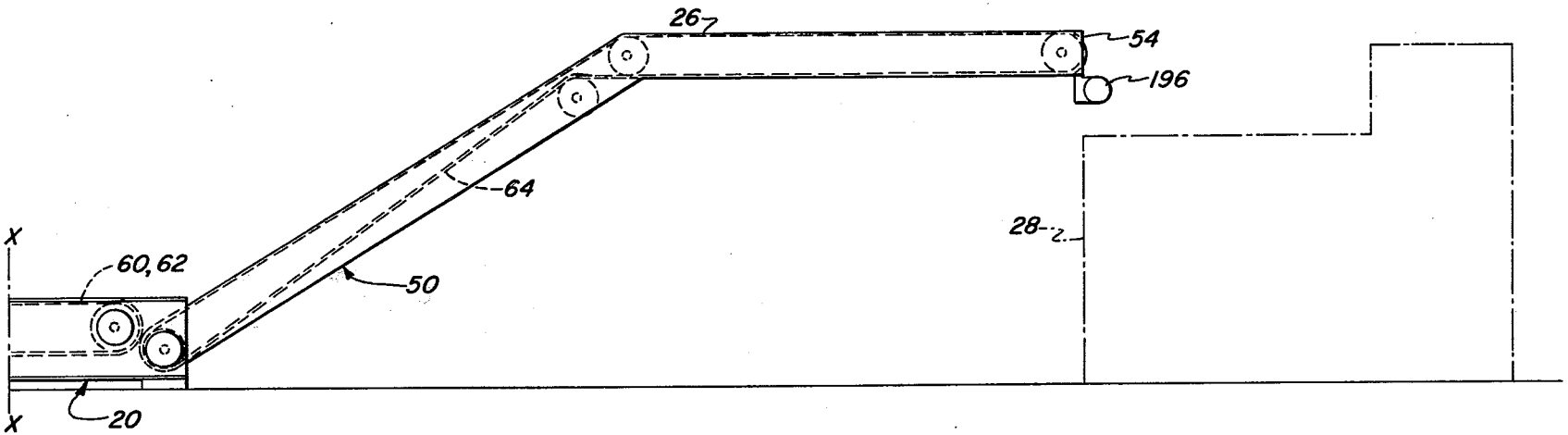

In order to assure that each subsequent stack 32 placed in the machine 20 has an appropriate height H, and is neither too tall nor too short to allow machine 20 to function as described immediately above, the control means of the machine is provided with stack-height-detector means shown in the form of a pair of input photoelectric detectors 190 and 192 located at the input end of the machine (see FIGS. 5 and 7). The upper detector 190 is placed at the upper limit of the acceptable height H of a stack 32, while the lower detector 192 is placed at the lower limit of acceptable height H. Control system 130 includes a logic control 194 responsive to the detectors 190 and 192 which will de-energize the conveyor motor units control 146 should both detectors simultaneously be de-energized, in which case the stack is too tall, or should both detectors simultaneously be energized, in which case the stack is too short. If the stack height falls within the acceptable range, upper detector 190 will be energized, while lower detector 192 will be de-energized and the logic control 194 will permit the conveyor motor units control 146 to operate the conveyor.

A further photoelectric detector 196 is placed at the output end of the machine 20 to detect the height of the stack of case blanks in the hopper 28. Should the height of the stack become great enough to de-energize the detector 196, the conveyor motor units control 146 will be de-energized and the conveyor will be stopped.

In this manner, overflow of the hopper 28 will not be permitted.

It is to be understood that the above detailed description of an embodiment of the invention is provided by way of example only. Various details of design and construction may be modified without departing from the true spirit and scope of the invention, as set forth in the appended claims.

The embodiments of the invention in which an exclusive property or privilege is claimed are defined as follows:

1. Apparatus for receiving blanks in given faced orientation within an upright stack having a longitudinal length and an altitudinal height, and delivering the blanks in shingled arrangement in reverse faced orientation, said apparatus comprising:

a frame;

a plurality of laterally spaced, longitudinally extending movable means mounted on the frame to establish a longitudinal conveyor having an input end and an output end, and providing a longitudinal path of travel for the blanks between the input and the output end;

drive means for moving the plurality of laterally spaced, longitudinally extending movable means to convey the blanks along the longitudinal path of travel in a downstream direction between the input end and the output end;

a first fork mounted upon the frame for pivotal movement about a laterally extending pivotal axis, said first fork including a plurality of longitudinally extending, laterally spaced first tines, the lengths of at least some of the first tines being greater than the height of the stack;

a second fork mounted upon the frame for pivotal movement independent of the first fork about the same laterally extending pivotal axis, said second fork including a plurality of longitudinally extending, laterally spaced second tines, the lengths of at least some of the second tines being great enough to support the length of the stack;

first actuating means for pivotally moving the first fork independent of the second fork between a first position wherein the first tines extend in an altitudinal direction normal to and intercepting the longitudinal path of travel of the blanks, and a second position wherein the first tines extend in a first longitudinal direction parallel to and juxtaposed with said path of travel;

second actuating means for pivotally moving the second fork independent of the first fork between a first position wherein the second tines extend in a second longitudinal direction parallel to and juxtaposed with said path of travel and opposite to said first longitudinal direction, and a second position wherein the second tines extend in an altitudinal direction at an obtuse angle to said second longitudinal direction and intercept said path of travel; and a control system including control means located along the path of travel of the blanks for activating the first and second actuating means in response to the location of the blanks such that upon disposition of the stack at a predetermined upsetting location wherein the stack is juxtaposed with the first and second forks, with each fork positioned at the first position thereof, the first and second actuating means will effect synchronized rotational movement of the forks in the same direction of rotation to the second positions thereof for upsetting the stack and placing the blanks in shingled arrangement upon the conveyor for delivery to the output end thereof, with the faced orientation of the delivered blanks being the reverse of the faced orientation of the blanks when in the stack.

2. The invention of claim 1 wherein the rotational movement of the first and second forks during movement from each respective first position toward each respective second position is in the direction from the input end of the conveyor toward the output end.

3. The invention of claim 1 wherein each first tine is aligned longitudinally with a corresponding second tine.

4. The invention of claim 1 wherein the tines of each fork are located laterally between the laterally spaced, longitudinally extending movable means.

5. The invention of claim 1 wherein the first and second forks are moved at the same rate of rotational movement as the forks are moved in synchronism from each first position toward each second position.

6. The invention of claim 1 wherein the rate of rotational movement of the second fork is slightly slower than the rate of rotational movement of the first fork.

7. The invention of claim 1 wherein said control system include means for commencing rotational movement of the second fork slightly after commencement of rotational movement of the first fork.

8. The invention of claim 1 wherein:

the first tines extend in a longitudinal direction from the pivotal axis toward the output end of the conveyor, when the first fork is in the second position thereof; and the second tines extend in a longitudinal direction from the pivotal axis toward the input end of the conveyor, when the second fork is in the first position thereof.

9. The invention of claim 8 wherein each first tine is aligned longitudinally with a corresponding second tine.

10. The invention of claim 1 wherein:

the first actuating means includes a first drive shaft journaled for rotation in the frame and extending laterally beneath the path of travel of the blanks coextensive with the laterally extending pivotal axis, each first tine being affixed to the first drive shaft for rotational movement therewith about said pivotal axis;

the second tines are journaled for rotation upon the first drive shaft independent of the rotation of the first drive shaft;

the second actuating means includes a second drive shaft journaled for rotation in the frame and extending laterally beneath the path of travel of the blanks parallel to the first drive shaft, and means coupling each second tine with the second drive shaft for pivotal movement of the second tines about the first drive shaft in response to rotational movement of the second drive shaft.

11. The invention of claim 10 wherein:

the first actuating means further includes at least one first actuator for rotating the first drive shaft between a first position, corresponding to the first position of the first fork, and a second position, corresponding to the second position of the first fork; and the second actuating means further includes at least one second actuator for rotating the second drive shaft between a first position, corresponding to the first position of the second fork, and a second position, corresponding to the second position of the second fork.

12. The invention of claim 11 wherein the means coupling each second tine with the second drive shaft includes a crank affixed to the second drive shaft adjacent each second tine, and a drive link interconnecting each crank with a respective second tine for moving the second fork between the first and second positions thereof in response to rotation of the second drive shaft between the first and second positions thereof.

13. The invention of claim 12 wherein the first and second drive shafts are spaced longitudinally from one another.

14. The invention of claim 12 wherein each first tine is aligned longitudinally with a corresponding second tine.

15. The invention of claim 1 wherein:

the first tines extend longitudinally from the pivotal axis in a downstream direction, when the first fork is in the second position thereof, and terminate at a given location along the path of travel of the blanks downstream from the pivotal axis;

the second tines extend longitudinally from the pivotal axis in an upstream direction, when the second fork is in the first position thereof;

the rotational movement of the first and second forks during movement from each respective first position toward each respective second position is generally in the downstream direction; and the control system includes first blank-detecting means located along the path of travel of the blanks for determining when the last blank of an upset stack is positioned at a first point between the input end of the conveyor and the given location where the first tines terminate;

second blank-detecting means located along the path of travel of the blanks for determining when said last blank of said upset stack is positioned at a second point beyond said given location in a downstream direction; and means responsive to the first blank-detecting means for precluding operation of the conveyor drive means unless a subsequent upright stack is present at the input end of the conveyor when the last blank of the previous upset stack arrives at the first point;

the longitudinal distance between the first point and the second point being so related to the longitudinal distance between the input end and the upsetting location, and to the stack length and height, as to assure that the first blank of the subsequent stack, when that stack is upset, will overlap with the last blank of the previous upset stack, whereby a continuous stream of blanks in shingled arrangement is delivered at the output end of the conveyor.

16. The invention of claim 15 wherein the control system further includes:

stack-height-detector means located at the input end of the conveyor for determining if the height of a stack at the input end falls within a prescribed range; and means responsive to the stack-height-detector means for precluding operation of the conveyor drive means unless the height of said stack falls within said prescribed range.

* * * * *